US007784583B1

(12) United States Patent
Hall et al.

(10) Patent No.: US 7,784,583 B1
(45) Date of Patent: Aug. 31, 2010

(54) DEEP INSERTION VENTED EARPIECE SYSTEM

(75) Inventors: John Allan Hall, Beavercreek, OH (US); Karl Cartwright, Colorado Springs, CO (US); Kris Cartwright, Colorado Springs, CO (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 233 days.

(21) Appl. No.: 11/417,281

(22) Filed: Apr. 24, 2006

Related U.S. Application Data

(60) Provisional application No. 60/675,437, filed on Apr. 25, 2005.

(51) Int. Cl.
*H04R 25/02* (2006.01)
*H04R 25/00* (2006.01)

(52) U.S. Cl. ..... 181/130; 181/135; 381/328; 381/380; 381/23.1

(58) Field of Classification Search ..... 181/130, 181/135, 131, 134; 381/322, 324, 328, 380, 381/68.6, 69, 23.1, 374; 128/864, 867
See application file for complete search history.

(56) References Cited

U.S. PATENT DOCUMENTS 1,830,198 A * 11/1931 French ..... 181/135
2,312,534 A * 3/1943 Flene ..... 181/135
2,430,229 A * 11/1947 Kelsey ..... 381/338
3,470,328 A 9/1969 Daniels
3,702,123 A * 11/1972 Macken et al. ..... 181/135
3,882,848 A * 5/1975 Klar et al. ..... 600/559
3,934,100 A 1/1976 Harada
4,069,400 A 1/1978 Johanson et al.
4,311,206 A * 1/1982 Johnson ..... 181/135
4,375,016 A * 2/1983 Harada ..... 181/135
4,442,917 A * 4/1984 Johnson ..... 181/135
4,443,668 A * 4/1984 Warren ..... 455/351
4,532,649 A * 7/1985 Bellafiore ..... 381/324
4,729,451 A * 3/1988 Brander et al. ..... 181/130
4,811,402 A * 3/1989 Ward ..... 381/322
4,852,684 A * 8/1989 Packard ..... 181/131
4,870,688 A * 9/1989 Voroba et al. ..... 381/60
4,880,076 A * 11/1989 Ahlberg et al. ..... 181/130
5,068,902 A * 11/1991 Ward ..... 381/328
5,195,139 A * 3/1993 Gauthier ..... 381/322
5,298,692 A * 3/1994 Ikeda et al. ..... 181/135
5,345,509 A * 9/1994 Hofer et al. ..... 381/326
5,357,576 A * 10/1994 Arndt ..... 381/328
5,449,865 A * 9/1995 Desnick et al. ..... 181/131
5,701,348 A * 12/1997 Shennib et al. ..... 381/328

(Continued)

*Primary Examiner*—Edgardo San Martin
(74) *Attorney, Agent, or Firm*—AFMCLO/JAZ; Jeffrey R. Moore

(57) ABSTRACT

A deep insertion vented earpiece system is described including resilient earpieces shaped to a wearer's ear canal for a conformal fit. A receptacle is provided within the outer surface of each earpiece for releasably receiving an audio plug. The audio plugs include a miniature loudspeaker and a pair of external ribs for mating with a corresponding pair of grooves formed along the periphery of the receptacle. This rib and groove feature provides for a secure retention of the audio plugs while enabling a simple removal operation. Each earpiece includes an audio passage to conduct the audio signal from the loudspeaker and a vent passage to enable continuous venting of the wearer's ear to atmosphere.

1 Claim, 3 Drawing Sheets

U.S. PATENT DOCUMENTS 5,824,968 A * 10/1998 Packard et al. ..... 181/131
6,137,889 A * 10/2000 Shennib et al. ..... 381/328
6,339,648 B1 * 1/2002 McIntosh et al. ..... 381/328
6,359,993 B2 * 3/2002 Brimhall ..... 381/328
6,434,248 B1 * 8/2002 Juneau et al. ..... 381/322
6,643,378 B2 * 11/2003 Schumaier ..... 381/326
6,661,901 B1 * 12/2003 Svean et al. ..... 381/328
6,724,902 B1 * 4/2004 Shennib et al. ..... 381/328
6,819,770 B2 * 11/2004 Niederdrank ..... 381/322
6,931,142 B2 * 8/2005 Fushimi ..... 381/325
7,027,608 B2 * 4/2006 Fretz et al. ..... 381/330
7,079,662 B2 * 7/2006 Niederdrank ..... 381/328
7,116,793 B2 * 10/2006 Seto ..... 381/322
2002/0136420 A1 * 9/2002 Topholm ..... 381/312
2002/0196954 A1 * 12/2002 Marxen et al. ..... 381/312
2004/0066939 A1 * 4/2004 Wong ..... 381/67
2004/0218772 A1 * 11/2004 Ryan ..... 381/328
2006/0045297 A1 * 3/2006 Haussmann ..... 381/322
2007/0189569 A1 * 8/2007 Haapapuro et al. ..... 381/380
2008/0080731 A1 * 4/2008 Svendsen et al. ..... 381/328
2008/0137891 A1 * 6/2008 Vohringer ..... 381/328

* cited by examiner

DEEP INSERTION VENTED EARPIECE SYSTEM

CROSS REFERENCE TO RELATED APPLICATIONS

The present application is related to and claims priority on prior copending provisional Application No. 60/675,437, filed Apr. 25, 2005, entitled Vented Earpiece System.

RIGHTS OF THE GOVERNMENT

This invention was made in the performance of a Cooperative Research and Development Agreement with the Department of the Air Force. The Government of the United States has certain rights to use the invention.

BACKGROUND OF THE INVENTION

The present invention relates generally to personal audio/hearing protection devices and more specifically to a modular earpiece system for connection to external radios, intercom systems and the like adapted to be worn deep in the ear of the wearer, to the second bend of the ear canal.

The desirability of personal audio devices to be worn in or on the wearer's ear is well known. Indeed, the commercial market is replete with such personal audio devices enabling the wearer to enjoy listening to music or other audio presentations without disturbing those nearby. Additionally, a large market exists for personal audio devices intended for use in loud environments such as mining, manufacturing, aerospace, music or motorsports to provide clear audio communications while protecting the ear from hazardous noise.

While many of these devices fit externally, on or over the wearer's ear, and are satisfactory for their intended purpose, a need exists for personal audio devices adapted to be worn within the wearer's ear canal. Such fitted devices provide better communications clarity, better ambient noise attenuation and if fitted properly, provide greater comfort.

One earpiece system commonly used today utilizes resilient foam earpieces having loudspeakers embedded therein. The loudspeakers are operatively connected to the audio source by attached audio cables. In use, the wearer compresses the foam plug with his fingertips and inserts the foam earpiece into the ear canal. The resilient foam then expands and conforms somewhat to the wearer's ear.

While these earpiece systems are in widespread use, they are not without the need for improvement. For example, the resilient foam provides only a limited degree of conformity to the contours of the wearer's ear canal. During use, the earpieces can become uncomfortable and they also tend to fall out. Additionally, the tendency of the wearer during removal of the earpieces is to pull on the audio cables rather than on the earpieces themselves, causing the audio cables to stretch, pull out or otherwise compromise the integrity of the earpiece system. Once the audio cables are pulled out of the earpieces, the system must be discarded.

Other earpiece systems include fitted, resilient earpieces, using the wearer's own ear as a template for molding the earpiece. These fitted earpieces provide improvements in comfort and ambient noise attenuation but suffer from the above described limitations inherent in the use of attached audio cables. Moreover, these fitted earpieces do not allow the external ear to vent to atmospheric changes associated with flight operations. While this venting feature is of limited usefulness to most wearers, aircraft pilots, particularly military pilots that experience drastic altitude induced pressure changes, can suffer injury if their is no venting/equalization.

Still other earpiece systems include resilient fitted earpieces having detachable audio cables. These systems represent an improvement over the non-detachable cable systems described above by enabling a more reliable two-step removal operation wherein the wearer removes the audio cables first, before removing the earpiece. This relieves the stress placed on the components during removal. Additionally, this two-step removal operation is of particular benefit to military pilots and aircrews because the integrity of the audio system is of paramount importance.

While earpiece systems including detachable audio cables represent an improvement over the other prior art systems, a need for improvement still exists. In light of the physically demanding, fast paced environment that military pilots are exposed to, a need exists for an earpiece system having detachable audio cables that are reliably secured within the earpieces themselves. Such a system would combine the desirable detachable audio cable feature with a means for providing a secure retention of the audio cable within the earpiece during system operation. Of course, the need for venting of the ear canal, described above, and deep insertion would remain for any military flight system.

SUMMARY OF THE INVENTION

Accordingly, it is a primary object of the present invention to provide a deep insertion vented earpiece system overcoming the limitations and disadvantages of the prior art.

Another object of the present invention is to provide a deep insertion vented earpiece system including resilient earpieces conformally shaped to a wearers ear canal.

Still another object of the present invention is to provide a deep insertion vented earpiece system including detachable audio plugs releasably retained within the earpieces.

Yet another object of the present invention is to provide a deep insertion vented earpiece system including conformally shaped resilient earpieces including a capillary vent passage to vent the external ear to atmosphere.

It is yet another object of the present invention to provide a deep insertion vented earpiece system including resilient earpieces conformally shaped to a wearer's ear canal that, when worn, terminate at the second bend of the wearers ear canal for optimal noise attenuation These and other objects of the invention will become apparent as the description of the representative embodiments proceeds.

In accordance with the foregoing principles and objects of the invention, a deep insertion vented earpiece system is described. The deep insertion vented earpiece system includes a pair of deep fitting resilient earpieces custom sized and manufactured to fit the contours of the wearer's ear canals exactly (from impressions of the wearers ears), to enhance comfort and maximize the attenuation of ambient noise. The earpieces are manufactured from silicone or other compliant, hypo-allergenic material and are cast from a custom mold made of the wearer's ear by techniques known to those having ordinary skill in the art. As used throughout, the term "deep fitting" or "deep insertion" pertains to custom fitted earpieces manufactured to be inserted such that the tip of the device rests against the second bend of the external ear canal. This deep insertion aspect of our invention represents a dramatic departure from the prior art earpieces that are made to be inserted to the first bend of the ear canal. Advantageously, this deep insertion feature of our invention has been demonstrated by extensive testing to provide superior noise reduction over the prior art earpieces.

The deep insertion vented earpiece system of the present invention additionally includes a pair of audio plugs that are removably insertable into a corresponding pair of receptacles provided within the outer surface of the earpieces. The audio plugs each include a miniature loudspeaker mounted within to provide an acoustical audio signal. Advantageously and according to an important aspect of the present invention, the audio plugs include a pair of externally mounted, parallel ribs to mate with corresponding grooves provided within the receptacles when inserted therein. This rib and groove feature of the present invention advantageously enables a secure retention of the audio plugs while enabling a simple removal operation.

The earpieces each include an audio passage to enable transmission of an audio signal between the loudspeaker within the audio plugs and the eardrum. Advantageously and according to an important aspect of the present invention, a capillary vent passage is also provided to enable continuous venting of the wearer's ear to atmosphere. This enhances user comfort while substantially avoiding middle ear barotrauma, a condition of discomfort in the ear caused by pressure due to an inability to equilibrate to ambient pressure changes.

BRIEF DESCRIPTION OF THE DRAWING

The accompanying drawing incorporated in and forming a part of the specification, illustrates several aspects of the present invention and together with the description serves to explain the principles of the invention. In the drawing.

DETAILED DESCRIPTION OF THE INVENTION

Figure 1:
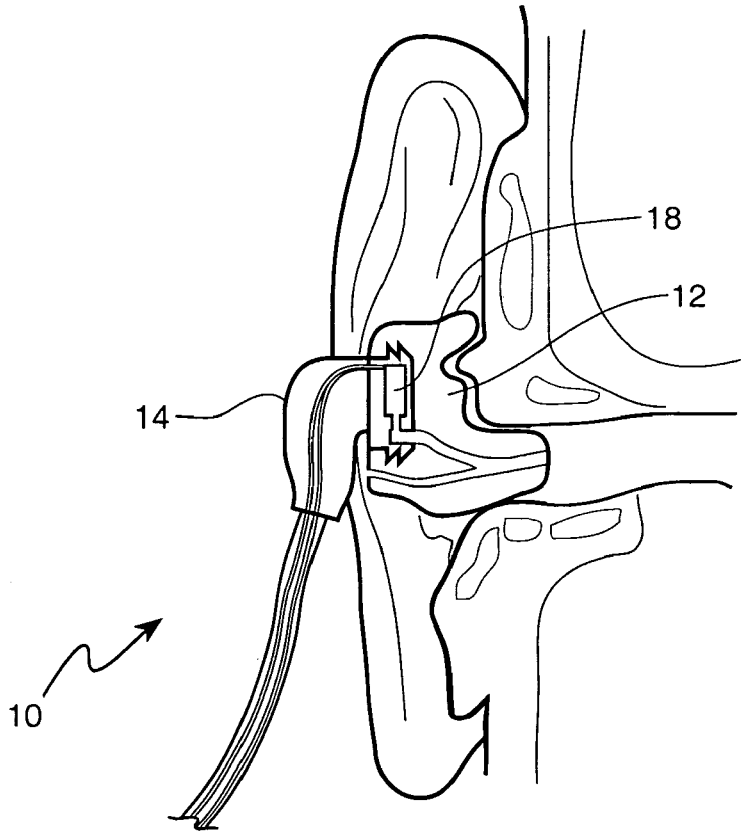
FIG. 1 is a diagrammatic cross sectional view of the deep insertion vented earpiece system of the present invention shown installed in a user's ear.

Reference is made to FIG. 1, showing a portion of the deep insertion vented earpiece system 10 of the present invention placed within the ear of a wearer. As will be described in more detail below, the deep insertion vented earpiece system 10 includes a pair of resilient, fitted earpieces 12 adapted to be worn within the ear. The earpieces 12 are custom sized and manufactured to fit the contours of the wearer's ear canals exactly (from impressions of the wearer's ears), to enhance comfort and maximize the attenuation of ambient noise. The earpieces 12 are manufactured from silicone or other compliant, hypo-allergenic material and are cast from a custom mold made of the wearer's ear by techniques known to those having ordinary skill in the art.

Figure 6:
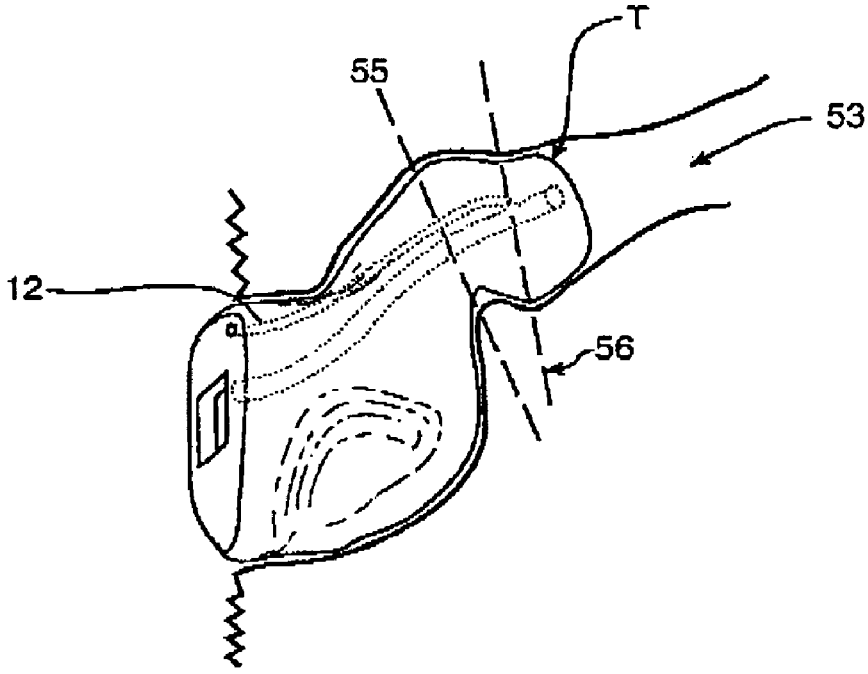

As used throughout and shown in FIG. 6, the term "deep fitting" or "deep insertion" pertains to custom fitted earpieces 12 manufactured to be inserted such that a tip T of the device rests against a second bend 56 of an external ear canal 53. This deep insertion aspect of our invention represents a dramatic departure from the prior art earpieces that are made to be inserted to a first bend 55 of the ear canal 53. Advantageously, this deep insertion feature of our invention has been demonstrated by extensive testing to provide superior noise reduction over the prior art earpieces. The view of FIG. 6 is from a person's neck up (or top down) to show the ear canal bends which are less visible from a typical face view as shown in FIG. 1. It should be pointed out that while the preferred embodiment of the present invention employs a pair of earpieces, satisfactory operation may be obtained in some situations from, the use of only one earpiece and thus the invention should not be considered so limited.

Figure 2:
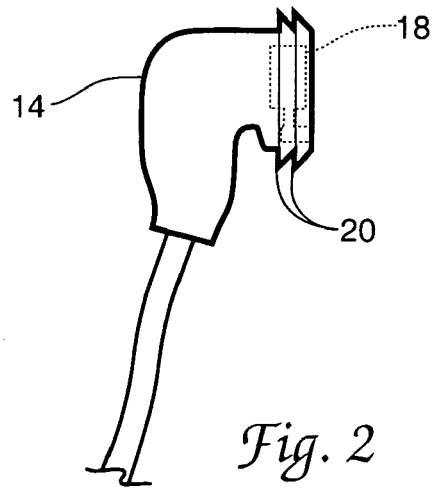
FIG. 2 is a plan view of an audio plug of the deep insertion vented earpiece system of the present invention.
Figure 3:
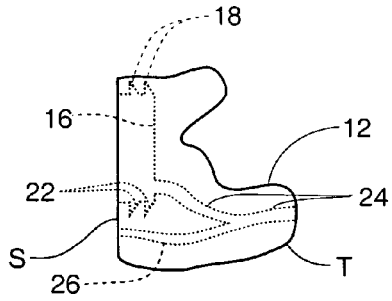
FIG. 3 is a cross sectional view of an earpiece of the deep insertion vented earpiece system of the present invention.

As shown in FIGS. 1 and 2, the deep insertion vented earpiece system 10 also includes a pair of audio plugs 14 that are removably insertable into a corresponding pair of receptacles 16, (FIGS. 3, 4*a* and 4*b*) provided within the outer surface S of the earpieces 12. The audio plugs 14 each include an internally mounted miniature loudspeaker 18, as shown in FIG. 1, to provide an acoustical audio signal from a radio, intercom system or the like. Advantageously and according to an important aspect of the present invention, the audio plugs 14 include a pair of externally mounted, parallel ribs 20, shown in FIG. 2, to mate with corresponding grooves 22 shown in FIG. 3 provided within the receptacles 16 when inserted therein. This rib and groove feature of the present invention advantageously enables a secure retention of the audio plugs 14 during use while enabling a simple removal operation, due to the resilient nature of the earpieces 12.

Figure 5:
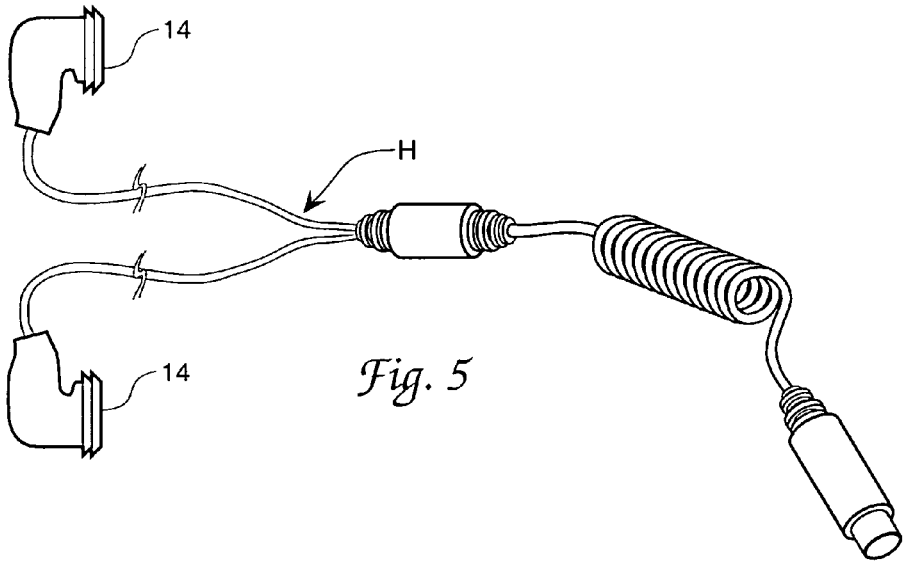
FIG. 5 is an illustration of an audio plug harness for use with the deep insertion vented earpiece system of the present invention; and, FIG. 6 is an illustration of the present invention in an ear canal from a neck up (or top down) orientation to show ear canal bends.

The separable feature of the earpieces 12 and the audio plugs 14 provides yet another advantage of the present invention in that the audio plugs 14 and the harness H, shown in FIG. 5, can be made to a standardized design. Only the earpieces 12 are custom made to the wearer. In this way, the deep insertion vented earpiece system 10 of the present invention can be readily adapted to a wide variety of users because each wearer is thus able to use his own custom molded earpieces 12 with any set of loudspeaker plugs 14 avoiding an expensive replacement of the entire assembly should the earpieces 12 or audio components fail.

Figure 4A:
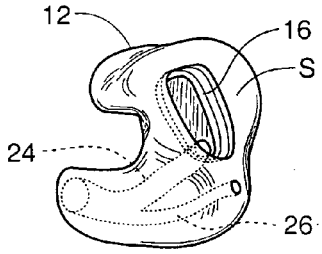
FIGS. 4*a* and 4*b* are perspective views of an earpiece of the deep insertion vented earpiece system of the present invention.
Figure 4B:
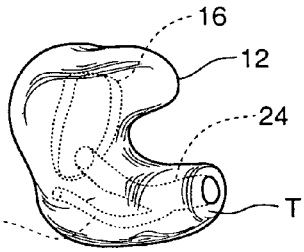

As shown in FIGS. 3, 4*a*, and 4*b*, the earpieces 12 each include an audio passage 24 in fluid communication with the receptacle 16 and an inner tip T of the earpiece 12. Additionally, when the audio plug 14 is inserted into the receptacle 16, the loudspeaker 18 is correspondingly placed in fluid communication with the audio passage 24. In this way, a passage for conducting the acoustical audio signal from the loudspeaker 18 to the ear is provided. Advantageously and according to an important aspect of the present invention, a capillary vent passage 26, enabling fluid communication between the inner tip T and the outer surface S of the earpiece 12, is also provided to enable continuous venting of the wearer's ear to atmosphere. This enhances user comfort while substantially avoiding middle ear barotrauma, a condition of discomfort or injury to the ear caused by pressure resulting from an inability of the ear to equilibrate to ambient pressure changes. After extensive testing, it has been determined that a vent passage 26 diameter of 0.020" provides satisfactory vent performance.

In summary, numerous benefits have been described from utilizing the principles of the present invention. The present invention provides a deep insertion vented earpiece system 10 shaped to a wearer's ear canal for a conformal fit. A receptacle 16 is provided within the outer surface of each earpiece 12 for releasably receiving an audio plug 14. The audio plugs 14 include a miniature loudspeaker 18 and a pair of external ribs

20 for mating with a corresponding pair of grooves 22 formed along the periphery of the receptacle 16. Each earpiece 12 includes an audio passage 24 to conduct the audio signal from the loudspeaker and a capillary vent passage 26 to enable continuous venting of the wearer's ear to atmosphere.

The foregoing description of the preferred embodiment has been presented for purposes of illustration and description. It is not intended to be exhaustive or to limit the invention to the precise form disclosed. Obvious modifications or variations are possible in light of the above teachings. The embodiment described was chosen to provide the best illustration of the principles of the invention and its practical application to thereby enable one of ordinary skill in the art to utilize the invention in various embodiments and with various modifications as are suited to the particular scope of the invention as determined by the appended claims when interpreted in accordance with the breadth to which they are fairly, legally and equitably entitled.

The invention claimed is:

1. A deep insertion vented earpiece system for an aircraft pilot ear with an ear canal having a first bend and a second bend, comprising: a resilient earpiece, said earpiece being custom shaped to a wearer's ear canal for a conformal fit therein to maximize attenuation of ambient noise; said earpiece made of silicon including an inner tip and an outer surface; an asymmetrical receptacle within said outer surface of said earpiece, said receptacle having a pair of parallel spaced compliant grooves along the periphery thereof, said inner tip resting against the second bend of the ear canal; an audio plug having a loudspeaker received therein, said audio plug having an outer periphery sized to conform to the periphery of said receptacle for releasable insertion therein, said audio plug further including a pair of parallel spaced compliant flanges projecting externally from said outer periphery thereof, said flanges being sized to conform to said grooves on the periphery of said receptacle to create an acoustic seal; while the audio plug further being safely separable during pilot aircraft ejection;

an audio passage within said earpiece in fluid communication with said receptacle and said inner tip of said earpiece, said audio passage further being in fluid communication with said loudspeaker when said audio plug is inserted into said receptacle; and, a vent passage within said earpiece, said vent passage being in fluid communication with said audio passage and said outer surface of said earpiece, said vent passage having a diameter of about 0.020 inches (0.508 mm).

* * * * *